United States Patent [19]

Handzel

[11] Patent Number: 4,503,573

[45] Date of Patent: Mar. 12, 1985

[54] SWIMMING POOL WATER CIRCULATION SYSTEM

[76] Inventor: James M. Handzel, 4439 W. Charter Oak, Glendale, Ariz. 85304

[21] Appl. No.: 512,425

[22] Filed: Jul. 11, 1983

[51] Int. Cl.[3] ..... E04H 3/16; E04H 3/18

[52] U.S. Cl. ..... 4/507; 4/490

[58] Field of Search ..... 4/507, 508, 509, 512, 4/490, 492; 134/167 R

[56] References Cited

U.S. PATENT DOCUMENTS

| | | | |
|---|---|---|---|
| 3,623,165 | 11/1971 | Whittall, Jr. | 4/492 X |
| 4,185,333 | 1/1980 | Ortega | 4/508 |
| 4,348,192 | 9/1982 | Pansini | 4/490 |
| 4,371,003 | 2/1983 | Goguen | 4/507 X |
| 4,378,254 | 3/1983 | Chauvier | 4/490 |

*Primary Examiner*—Henry K. Artis

*Attorney, Agent, or Firm*—Herbert E. Haynes, Jr.

[57] ABSTRACT

A swimming pool water circulation system having a two-state valve which is alternately operated for predetermined lengths of time in a first state wherein water flow through the system is at a relatively low pressure high volume flow rate for efficient water filtration and in a second state wherein the water flows through the system to a pool cleaning device or system at a relatively high pressure low volume flow rate for efficient operation of the pool cleaning system or device.

16 Claims, 1 Drawing Figure

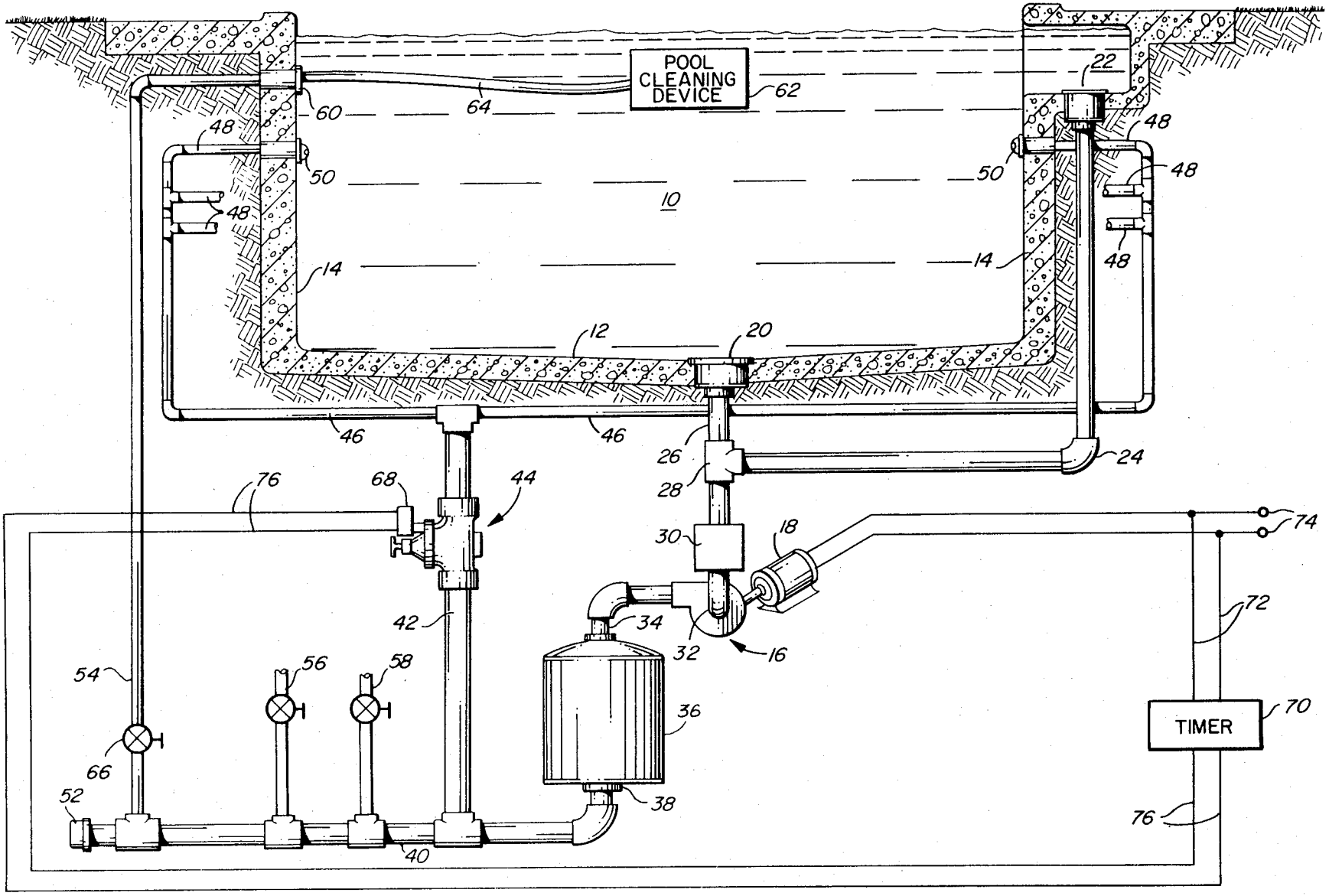
TIMER
POOL CLEANING DEVICE
10
12
14
16
18
20
22
24
26
28
30
32
34
36
38
40
42
44
46
48
50
52
54
56
58
60
62
64
66
68
70
72
74
76

SWIMMING POOL WATER CIRCULATION SYSTEM

BACKGROUND OF THE INVENTION

1. Field of the Invention

This invention relates generally to swimming pools and more particularly to a new and improved water circulation system for filtering the water and automatically cleaning the interior surfaces of the swimming pool.

2. Description of the Prior Art

Various automatic cleaning systems and devices have been successfully used to eliminate or at least substantially reduce the tedious and repetitious task of manually cleaning dirt, sediment, leaves and other foreign matter from the bottom and sidewalls of swimming pools.

Among the cleaning devices in common use, are those usually referred to as "whips". Elongated flexible tubes are connected to suitable fixtures provided at various locations in the sidewalls of the swimming pool. Water under pressure is directed to the tubes causing them to whip, that is, move in a sinusoidal motion, in response to jet efflux from the ends of the tubes. The whipping action and jet streams agitates settled foreign matter and places it in suspension so that it can be carried through the swimming pool's water circulation system and extracted from the water by the inherent action of the filtering system.

Another cleaning system and device accomplishes the same objective by providing a plurality of motor driven rotating jet nozzles located at various locations in the bottom of the pool. These jet nozzle devices are rotatably driven and the jet streams efflux from the nozzles is a result of the water under pressure which is supplied thereto.

A third, and probably most commonly used type of pool cleaning device is generally referred to as a "pool sweep". Although there are several types of pool sweeps available, they all operate more or less on the same basic principles. Pool sweeps are usually hydromechanical mechanisms which are teathered by a single elongated flexible hose to a suitable water supply conduit which terminates in a pool sidewall mounted fitting. The hose directs water under pressure to the pool sweep to drive it in random movement paths about the interior of the pool and to operate the agitation device or devices of the pool sweep.

As is well known, a swimming pool water circulation system must be operated at relatively low pressure high volume flow rates for proper and efficient water filtration. As a result of this, a problem exists in that all of the pool cleaning systems or devices discussed above require that the water supplied thereto be at a relatively high pressure low volume flow rate for proper and efficient operation.

U.S. Pat. No. 3,483,878 suggests that this problem can be overcome by diverting some of the low pressure high volume water flowing through the circulation system, restrict the volume of the diverted water by use of a manually adjustable gate valve to increase its pressure and supply the diverted water to a cleaning system. Therefore, in this prior art system water will flow back to the pool through the usual return plumbing arrangement and will be simultaneously supplied to the cleaning system. However, this prior art system results in a compromise in that an unsatisfactory reduction of the water flow rate in the circulation system results in a loss of filtration efficiency and the diverted water supplied to the cleaning device is at a less than ideal high pressure low volume flow rate required for efficient operation of the cleaning device.

For this reason, it is a common prior art practice to install a booster pump in a reduced diameter water diversion conduit leading from the pool's water circulation system to the cleaning device or devices. Such a booster pump provides the needed high pressure low volume water flow to the cleaning device or devices without reducing the low pressure high volume flow rate in the filtering system.

However, the addition of a booster pump causes problems in that it, of course, increases the initial and operating costs, increases the complexity of the water circulation system, and increases the possibility of system failure or malfunction.

Therefore, it is desirable to provide a new and improved swimming pool water circulation system which overcomes, or at least substantially reduces, the problems of the prior art.

SUMMARY OF THE INVENTION

In accordance with the present invention, a new and improved system and method of operation thereof is disclosed for filtration of swimming pool water and for automatic low cost and efficient cleaning of the dirt, sediment and similar foreign materials from the bottom and sidewall surfaces of swimming pools.

The water circulation system includes a swimming pool cleaning sub-system and a water filtering sub-system with the filtering sub-system being of the type having a pump which withdraws water from the pool, such as from a bottom drain and surface skimmer drain, and directs that water through a suitable filter means. The filter means removes dirt and other foreign matter from the water and returns the water back to the swimming pool through a filtered water return plumbing arrangement. The return plumbing arrangement includes a relatively large diameter main return conduit which directs the filtered water, under pressure provided by the above mentioned pump, to a manifold means wherein the filtered water is divided so that it returns to the pool through a plurality of branch return conduits. In addition to the manifold means and branch return conduits, the main return conduit has a reduced diameter water flow diversion conduit extending therefrom to a suitable location or locations in the interior surface of the swimming pool. The flow diversion conduit directs water from the main return conduit to the swimming pool cleaning device or devices for operation thereof. The pool cleaning device may be any system or device which operates on water pressure such as those hereinbefore described.

In accordance with the present invention, the main return conduit is provided with a two-state valve means therein by which filtered water flow to the manifold means and branch return conduits may be shut off so that all the water flowing from the pool filter means is directed into the water flow diversion conduit. When the two stage valve means is in its first, or open state, the filtered water from the pool's filter means flows through the return plumbing arrangement at a relatively low pressure high volume flow rate which is necessary for proper and efficient operation of the swimming pool's filtering system. When the two-state valve means is in its second, or closed state, all the filtered water is forced to flow through the flow diversion conduit. The reduced diameter of the flow diversion conduit will result in a reduction of the volume and an increase in the pressure of the water flowing therethrough. The relatively high pressure low volume water flow resulting from closing of the two-state valve means is necessary for proper and efficient operation of the pool cleaning device or devices.

The two-state valve means is preferably a solenoid operated valve which is normally open and will close when its solenoid is actuated, with such actuation being under control of a suitable timing means.

In accordance with the method of the present invention, the two-state valve means is operated in its open state so that the system will operate in a normal water filtering mode for a large part of a given time period, and the valve is closed for operation of the system in a pool cleaning mode for the remaining relatively short portion of that operational time period. By way of example, the two-state valve means can be open for about 50 minutes of each operational hour for operation in the normal water filtering mode and is closed for the remaining 10 minutes of each operational hour. In this manner, any settled dirt, sediment or other foreign matter will be agitated to put it into suspension during the relatively short cleaning mode operating time, 10 minutes in the above example. Upon termination of this relatively short time of operation in the cleaning mode, the two-state valve is opened, thus returning the filtering system to its normal water filtration operating mode so that the matter placed in suspension during the previous cleaning mode can be removed from the water during the normal filtering mode.

Accordingly, it is an object of the present invention to provide a new and improved water circulation system for filtering swimming pool water and for automatic low cost and efficient cleaning of dirt, sediment, and similar foreign matter from the bottom and sidewalls of the swimming pool.

Another object of the present invention is to provide a new and improved water circulation system of the above described character wherein the circulation system is operable in a normal water filtering mode for a given period of time and is operable in a pool bottom and sidewall surface cleaning mode for another given period of time.

Another object of the present invention is to provide a new and improved swimming pool water circulation system of the above described character wherein the system includes a water filtering sub-system and a pool cleaning sub-system and means for switching operation between those two sub-systems.

Another object of the present invention is to provide a new and improved swimming pool water circulation system of the above described character wherein the means for switching includes a two-state valve means in the main filtered water return conduit of the system with the two-state valve means having a first, or open, state wherein the system operates in a normal water filtering operational mode and having a second, or closed, state wherein the system operates in a pool cleaning operational mode.

Still another object of the present invention is to provide a new and improved swimming pool water circulation system of the above described character wherein the means for switching includes a solenoid operated two-state valve which is actuable between its first and second states under the control of a timing device means.

The foregoing and other objects of the present invention, as well as the invention itself, will be more fully understood from the following description when read in conjunction with the accompanying drawing.

BRIEF DESCRIPTION OF THE DRAWING

The single FIGURE of drawing shows a diagrammatic view of a fragmentary portion of a swimming pool which is provided with the improved water circulation system of the present invention.

DESCRIPTION OF THE PREFERRED EMBODIMENT

Referring more particularly to the drawing, the single FIGURE diagrammatically illustrates a fragmentary portion of a typical swimming pool 10 having the usual bottom surface 12 and sidewalls 14. Although the pool 10 is shown as being of the type which is installed in the ground, it is to be understood that this is not intended as a limitation in that the water circulation system of the present invention will function with any type of pool.

The pool 10 is provided with the water circulation system of the invention which includes the usual pump means 16 which is driven by a suitable electric motor 18 so as to withdraw water from the pool through the usual bottom drain 20 and surface skimmer drain 22. The bottom and skimmer drains are connected by suitable conduits 24 and 26 to a tee-fitting 28 which is coupled through a suitable filter 30 to the inlet 32 of the pump 16. The filter 30 may be of the removable basket type usually used in the inlet line to swimming pools to collect relatively large debris, such as leaves, grass clippings, and the like.

The pump means 16 delivers the water under pressure via a conduit 34 to the inlet of a filter means 36 of the type designed to remove fine foreign materials from the water, such as dirt, and the like. The filter means 36 may be any of the filter devices commonly used for this purpose, such as a rapid sand filter, cartridge type filter, or a diatomaceous earth filter.

The filtered water emerging from the outlet 38 of the filter means 36 enters into a first manifold 40 from which extends a main water return conduit 42 of relatively large diameter. The main return conduit 42 has a two-state valve means 44 mounted therein for reasons which will hereinafter be described in detail. The main water return conduit 42 terminates in a second manifold 46 which divides the filtered water so that it flows back into the pool through a plurality of return branch conduits 48. As is customary, the branch conduits 48 extend to various locations in the sidewalls of the pool and are connected to nozzles 50 that are mounted in the sidewalls of the pool. The return conduit 42, manifold 46, and the branch conduits 48 constitute what may be defined as the filtered water return plumbing means.

The first manifold 40 is closed as with a cap 52 on its free end and has a flow diversion conduit 54 extending therefrom, and may have similarly extending pool accessory operating conduits 56 and 58. The accessory operating conduits 56 and 58 are optional and are used, for example, to direct water to aeration sprinklers (not shown), aerated water jet nozzles (not shown), and the like.

The flow diversion conduit 54 is shown as extending from the first manifold 40 to a water outlet fitting 60 provided in the sidewall 14 of the swimming pool 10. A swimming pool cleaning device 62 is shown as being coupled, such as by means of an elongated flexible hose 64, to the outlet fitting 60. Therefore, filtered water will be diverted from the first manifold 40 by the diversion conduit 54 and directed to the cleaning device means 62. The diversion conduit 54 is shown as having a manually operated valve 66 therein. This valve is normally open and is provided for service and maintenance purposes only, in that it serves no function with regard to the water circulation system of the present invention.

The pool cleaning device means 62 is shown as being connected in the manner in which a hydro-mechanical cleaning mechanism is coupled to receive water under pressure from the pump 16. It is to be understood that it is not intended as a limitation in that the water circulation system of the present invention will function equally as well on other types of cleaning devices or systems, such as the hereinbefore discussed whips, rotating jet nozzles, and the like.

In the preferred embodiment, the two-state valve means 44 has a normally open state with the valve being actuatable to its closed state by means of a solenoid 68 which is integral with the valve.

When the two-state valve means 44 is in its normal open state, the swimming pool water circulation system of the present invention is in a normal water filtration operational mode. In this mode, filtered water under pressure from the filter means 36 is returned to the pool 10 through the main water return conduit 42, the second manifold 46, the branch conduits 48, and the nozzles 50. Also, this filtered water will flow through the diversion conduit 54 to the pool cleaning means 62. In this normal, or water filtration mode, the filtered water is at a relatively low pressure and a relatively high volume flow rate which is needed for proper and efficient water filtration. This low pressure high volume flow rate is not correct for proper and efficient operation of the cleaning device means 62, and the relatively small amount flowing through the diversion conduit 54 to the cleaning device 62 will amount to little more than a leakage flow and will not properly or efficiently operate the cleaning device means.

When the solenoid 68 is actuated to switch the two-state valve 44 to its closed state, all flow through the main water return conduit 42 will, of course, be shut off, and the circulation system will be in the pool cleaning operational mode. When in this pool cleaning mode, the filtered water at full pump pressure will flow only through the diversion conduit 54. Due to the reduced diameter of the diversion conduit 54 in comparison to the main water return conduit 42, the water flowing through the diversion conduit will be at high pressure and low volume, and the cleaning device means 62 will be operated in a proper and efficient manner.

In accordance with the method of the present invention, the water circulation system is operated in its normal water filtration mode for the larger portion of a given operational time period and is switched to its pool cleaning operational mode for the balance of that time period. During the water filtration operational mode, a water flow pattern is set up, or continued, within the pool itself to carry dirt and other foreign materials to the bottom drain and skimmer drain of the pool. Although flow patterns will differ from pool to pool, and all pools having a modern filtering system will establish some sort of flow pattern, and this flow pattern takes time to become properly established due to inertia and will continue on for a time period after the pool's pump has been shut off. The inertia induced flow of water in the pool allows the method of the operating system of the present invention to be a low-cost and yet very efficient way of accomplishing both water filtration and interior surface cleaning of the pool.

An example of the operational time relationships of the two operational modes within a given operating time period, it has been found that operating the water circulation system in its water filtration mode for about fifty (50) minutes of each hour and switching it to the cleaning operational mode for the remaining time, ten (10) minutes, of that hour will work quite well in accomplishing both the filtering and cleaning tasks. The fifty minute time period will establish and continue the pattern of water flow within the pool, so that when the system is switched to the interior pool surface cleaning mode, the cleaning device means 62 will agitate any settled foreign matter and place it in suspension within the on-going inertia induced flow pattern. When the inertia induced water flow pattern attenuates and is approaching an unacceptable flow rate, i.e., about ten (10) minutes after switching to the cleaning mode, the system is switched back into the filtration mode which reestablishes the maximum flow rate of the water flow pattern in the pool, so that the suspended foreign matter will be carried to the drains 20 and 22 and thus through the filter means 36. It is to be understood that the time relationships given above are merely exemplary, and although the times were established as the result of experimentation and testing, they may vary in accordance with pool characteristics.

A variety of two-state valves are commercially available for accomplishing the operational mode switching function described above such as the solenoid valve identified as the Richdel model R216PR, available from Richdel, Inc., 1851 Oregon Street, Carson City, Nev., 89701.

The actuation and deactuation of the solenoid valve 44 to accomplish the desired operational mode switching of the circulation system of the present invention may be accomplished by any suitable timing means 70. The timing means 70 may be an electrically operated clock-timer device of the type customarily used to control swimming pool functions, and the like. By connecting the electric input wires 72 of the timer 70 to the power supply lines 74, which drive the motor of the pump 16, the timer means 70 will become operational whenever power is supplied to the pump motor 18. The output wires 76 of the timer means 70 are connected in a conventional manner to the solenoid 68 for actuation and deactuation thereof under control of the timer means 70. Other electric wiring arrangements may obviously be used, such as, for example, incorporating a voltage reduction transformer (not shown) in the system to reduce the voltage and using a low voltage timer means and a low voltage solenoid.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A water circulation system for a swimming pool of the type having an associated water operated cleaning means for cleaning the interior surfaces of the pool, said water circulation system comprising:

(a) pump means for withdrawing water to be filtered from the swimming pool;

(b) filter means coupled to receive the water to be filtered from the pump means;

(c) a filtered water return plumbing means connected to receive the filtered water from said filter means for returning the filtered water to the swimming pool at a relatively low pressure high volume flow rate;

(d) a two-state valve means in said return plumbing means with the first state being an open state for allowing the flow of filtered water through said return plumbing means with the second state being a closed state for stopping the flow of filtered water therethrough; and (e) a diversion conduit coupled to said return plumbing means between said filter means and said two-state valve means for directing the flow of filtered water to the cleaning means associated with the swimming pool at a relatively high pressure low volume flow rate when said two-state valve means is in its closed state.

2. A water circulation system as claimed in claim 1 and further comprising means connected to said two-state valve means for automatically switching said two-state valve means between its first and second states at predetermined intervals.

3. A water circulation system as claimed in claim 1 and further comprising:

(a) said two-state valve means including a solenoid for switching between the first and second states of said two-state valve means; and (b) means connected to the solenoid of said two-state valve means for automatically actuating the solenoid at predetermined intervals and deactuating the solenoid after a predetermined interval.

4. A water circulation system as claimed in claim 3 wherein said means connected to said solenoid of said two-state valve means is a timing means in the power supply line of the solenoid to periodically couple power to the solenoid for actuation thereof and periodically interrupt the power to the solenoid for deactuation thereof.

5. A water circulation system as claimed in claim 1 wherein said diversion conduit is of restricted flow capacity in comparison to said return plumbing means so that when said two-state valve means is in its closed state, the flow of filtered water through said diversion conduit will be at a higher pressure lower volume flow rate than the flow of water through said return plumbing means when said two-state valve means is in its open state.

6. A swimming pool water circulation system comprising:

(a) a swimming pool having at least one water drain outlet and at least one water return inlet;

(b) cleaning means associated with said swimming pool for cleaning the interior surfaces thereof, said cleaning means being operable in response to a relatively high pressure low volume flow of water being directed thereto;

(c) pump means coupled to the water drain outlet of said swimming pool for withdrawing water therefrom;

(d) filter means coupled to receive the water from said pump means and having an outlet;

(e) a filtered water return plumbing means coupled between the outlet of said filter means and the water return inlet of said swimming pool for returning the water filtered by said filter means to said swimming pool at a relatively low pressure high volume flow rate;

(f) a two-state valve means in said return plumbing means with the first state being an open state to allow the flow of filtered water through said water return plumbing means and the second state being a closed state for stopping the water flow therethrough; and (g) a diversion conduit coupled between the outlet of said filter means and said cleaning means for directing filtered water from said filter means to said cleaning means at a relatively high pressure low volume flow rate when said two-state valve means is in its closed state.

7. A swimming pool water circulation system as claimed in claim 6 wherein said diversion conduit is of reduced diameter in comparison to said return plumbing means to produce the relatively high pressure low volume flow rate of filtered water through said diversion conduit when said two-state valve means is in its closed state.

8. A swimming pool water circulation system as claimed in claim 6 and further comprising means for automatically switching said two-state valve means between its first and second states at predetermined time intervals.

9. A swimming pool water circulation system as claimed in claim 6 and further comprising:

(a) said two-state valve means being normally open to provide the first state thereof;

(b) a solenoid integral with said two-state valve means for switching said two-state valve means to its second state upon actuation of said solenoid; and (c) timing means in the power supply line of said solenoid to periodically couple power thereto for an adjustably variable predetermined time and to interrupt the power upon expiration of that predetermined time.

10. A method for operating a swimming pool water circulation system comprising the steps of:

(a) pumping water from a swimming pool through a filter means;

(b) operating a two-state valve means in a first state so that filtered water from said filter means flows through a water return plumbing means back to the swimming pool to operate in a water filtration operational mode;

(c) operating said two-state valve means in a second state so that the filtered water from said filter means flows through a diversion conduit to a means for cleaning the internal surfaces of the swimming pool to accomplish a pool cleaning operational mode; and (d) alternating the operation of said two-state valve means between its first and second states.

11. A method as claimed in claim 10 wherein the step of operating said two-state valve means in the first state provides a relatively low pressure high volume water flow rate through the water circulation system for efficient water filtration.

12. A method as claimed in claim 10 wherein the step of operating said two-state valve means in the second state provides a relatively high pressure low volume water flow rate through the water circulation system to said means for cleaning the interior surfaces of the swimming pool for efficient operation of said means for cleaning the interior surfaces of the swimming pool.

13. A method as claimed in claim 10 wherein the step of alternating the operation of said two-state valve means between its first and second states is accomplished at timed intervals.

14. A method as claimed in claim 10 wherein the step of alternating the operation of said two-state valve means between its first and second states is accomplished at adjustably variable time intervals.

15. A method as claimed in claim 10 wherein the step of alternating the operation of said two-state valve means between its first and second states is accomplished at timed intervals with the operation of said two-state valve means in its first state being accomplished for a larger portion of a given time period and the operation of said two-state valve means in its second state being accomplished for the remaining relatively shorter portion of said given time period.

16. A method as claimed in claim 10 wherein the step of alternating the operation of said two-state valve means between its first and second states is accomplished at timed intervals with the operation of said two-state valve means in its first state being accomplished for approximately fifty minutes of each operational hour and the operation of said two-state valve means in its second state being accomplished for approximately ten minutes of each operational hour.

* * * * *